US012280920B2

(12) United States Patent
Bull

(10) Patent No.: US 12,280,920 B2
(45) Date of Patent: Apr. 22, 2025

(54) CLOSURE

(71) Applicant: OBRIST CLOSURES SWITZERLAND GMBH, Reinach (CH)

(72) Inventor: Martin Bull, Tasburgh (GB)

(73) Assignee: OBRIST CLOSURES SWITZERLAND GMBH, Reinach (CH)

( * ) Notice: Subject to any disclaimer, the term of this patent is extended or adjusted under 35 U.S.C. 154(b) by 0 days.

(21) Appl. No.: 18/214,683

(22) Filed: Jun. 27, 2023

(65) Prior Publication Data

US 2024/0002111 A1 Jan. 4, 2024

Related U.S. Application Data

(63) Continuation of application No. 17/635,128, filed as application No. PCT/EP2020/073035 on Aug. 17, 2020, now abandoned.

(30) Foreign Application Priority Data

Aug. 15, 2019 (GB) ..... 1911733
Sep. 22, 2019 (GB) ..... 1913646

(51) Int. Cl.
*B65D 47/20* (2006.01)
*B65D 47/08* (2006.01)

(52) U.S. Cl.
CPC ..... *B65D 47/0814* (2013.01); *B65D 47/2031* (2013.01); *B65D 47/2075* (2013.01)

(58) Field of Classification Search
CPC ..... B65D 47/243; B65D 47/2075; B65D 47/0814; B65D 47/2031; B65D 47/2081
USPC ..... 222/490, 494, 514
See application file for complete search history.

(56) References Cited

U.S. PATENT DOCUMENTS 2,628,004 A * 2/1953 Schlicksupp ..... B65D 47/2081 222/514
3,981,419 A 9/1976 Nilson
4,141,474 A * 2/1979 Nilson ..... B65D 47/2081 222/493

(Continued)

FOREIGN PATENT DOCUMENTS

DE 19510007 A1 10/1995
GB 2465843 A 6/2010

(Continued)

OTHER PUBLICATIONS

Extended European Search Report for counterpart European App. No. for EP23180787.6 dated Sep. 11, 2023, 7 pages.

(Continued)

*Primary Examiner* — Charles P. Cheyney
(74) *Attorney, Agent, or Firm* — Barnes & Thornburg LLP

(57) ABSTRACT

A dispensing closure for a flowable product is provided. The closure comprises a dispensing channel having a dispensing orifice, and a separate flow control member movable with respect to the dispensing channel. The flow control member is movable from a sealed position in which it prevents product flow through the dispensing orifice and an unsealed position in which fluid can flow around and/or within the flow control member to reach the dispensing orifice.

13 Claims, 22 Drawing Sheets

(56) References Cited

U.S. PATENT DOCUMENTS

| | | | | |
|---|---|---|---|---|
| 4,314,658 | A * | 2/1982 | Laauwe | B65D 47/2081 137/197 |
| 4,699,300 | A * | 10/1987 | Blake | B65D 47/2081 222/481 |
| 5,692,651 | A * | 12/1997 | Fuchs | B65D 47/2081 222/494 |
| 5,842,618 | A * | 12/1998 | Julemont | B65D 47/2031 222/153.07 |
| 6,006,960 | A * | 12/1999 | Gross | B65D 47/0809 222/545 |
| 6,176,399 | B1 | 1/2001 | Schantz | |
| 6,325,253 | B1 | 12/2001 | Robinson | |
| 6,367,668 | B1 * | 4/2002 | Schwanenberg | B65D 47/2031 222/490 |
| 6,371,340 | B1 * | 4/2002 | Pateman | B65D 47/2031 222/494 |
| 6,749,092 | B2 * | 6/2004 | Olechowski | B65D 47/2031 222/525 |
| 7,255,250 | B2 * | 8/2007 | Pugne | B65D 47/0804 222/546 |
| 7,503,469 | B2 * | 3/2009 | Bloom | B65D 47/2031 222/212 |
| 8,863,998 | B2 * | 10/2014 | Painchaud | B05B 11/00444 222/1 |
| 9,060,592 | B2 * | 6/2015 | Brosius | B65D 47/06 |
| 9,630,829 | B2 * | 4/2017 | Sokol | B65D 47/2031 |
| 10,259,624 | B2 * | 4/2019 | Sakimura | B65D 47/0838 |
| 10,472,140 | B2 * | 11/2019 | Jones | B65D 5/42 |
| 10,954,043 | B2 * | 3/2021 | Taruno | B05B 11/047 |
| 11,033,922 | B2 * | 6/2021 | Julia | A61F 9/0008 |
| 2003/0085240 | A1 * | 5/2003 | Dark | B65D 47/2081 222/494 |
| 2013/0026196 | A1 * | 1/2013 | Essebaggers | B65D 47/2075 222/482 |
| 2016/0023884 | A1 | 1/2016 | Sokol | |
| 2022/0089335 | A1 | 3/2022 | Morren | |

FOREIGN PATENT DOCUMENTS

| | | | |
|---|---|---|---|
| JP | 8026320 | A | 1/1996 |
| WO | 199526306 | A1 | 10/1995 |
| WO | 9964313 | A1 | 12/1999 |
| WO | 200006460 | A1 | 2/2000 |
| WO | 2015092452 | A1 | 6/2015 |
| WO | 2015181730 | A1 | 12/2015 |
| WO | 2020120053 | A1 | 6/2020 |
| WO | 2022086691 | A1 | 4/2022 |

OTHER PUBLICATIONS

International Search Report and Written Opinion for PCT/EP2020/073035 dated Dec. 7, 2020.

International (PCT) Search Report and Written Opinion for PCT/US2024/040934 dated Dec. 30, 2024, BP-631 PCT || (5723-415455), 29 pages.

* cited by examiner

CLOSURE

CROSS REFERENCE TO RELATED APPLICATIONS

This application is a continuation of U.S. application Ser. No. 17/635,128, filed Feb. 14, 2022, which is a U.S. national stage application under 35 U.S.C. § 371(b) of International Application No. PCT/EP2020/073035, filed Aug. 17, 2020, which claims priority to the United Kingdom Patent Application No. 1911733.2, filed on Aug. 15, 2019, and United Kingdom Patent Application No. 1913646.4, filed Sep. 22, 2019, the disclosures of each of which are hereby expressly incorporated by reference in their entirety.

The present invention relates generally to a closure and particularly, although not exclusively, to a dispensing closure including flow control functionality.

A dispensing closure is one which is typically held in place on, and associated with, the mouth of a container. They often have an orifice which is associated with the orifice in the container such that the contents of the container may only be dispensed via the orifice in the closure.

Such dispensing closures often also comprise a lid which may be hinged to the dispensing closure and which may be formed integrally therewith (known, for example, as a flip-top dispensing closure). The purpose of the lid is often to seal the orifice in the closure so that, in the closed position, no product may be dispensed whether deliberately or accidentally.

The present invention provides or relates to improvements in or relating to dispensing closures.

An aspect of the present invention provides a dispensing closure for a flowable product, the closure comprising a dispensing channel having a dispensing orifice, and a flow control member movable with respect to the dispensing channel, the flow control member is movable from a sealed position in which it prevents product flow through the dispensing orifice and an unsealed position in which fluid can flow around and/or within the flow control member to reach the dispensing orifice.

In some embodiments the flow control member is formed as a separate insert.

An aspect of the present invention provides a dispensing closure for a flowable product, the closure comprising a dispensing channel having a dispensing orifice, and a separate flow control member movable with respect to the dispensing channel, the flow control member is movable from a sealed position in which it prevents product flow through the dispensing orifice and an unsealed position in which fluid can flow around and/or within the flow control member to reach the dispensing orifice.

The flow control member may be biased to the sealed position and movable to the unsealed position.

The flow control member may be provided with one or more spring members which resiliently bias the flow control member to the sealed position.

The flow control member and the dispensing channel may be provided with cooperating sealing surfaces. The flow control member may be biased to cause the sealing surfaces to seal against each other.

In some embodiments the flow control member is provided with one or more springs and the or each spring bears against the dispensing channel, and in which product flow pressure causes the or each spring to bend against the dispensing channel so that the flow control member moves to an unsealed position within the channel to allow product to flow to the dispensing orifice, and in which when the pressure is released the or each spring move the movable part back to the sealed position.

The or each spring may be positioned at an end of the dispensing channel, for example at one end of a generally cylindrical channel.

The flow control member may be translatable between the sealed and unsealed positioned within the dispensing channel and along a main axis thereof.

In the unsealed position a fluid flow path may defined between the dispensing channel and around the flow control member; for example around the sides of the flow control member. This may mean, for example, that there is no flow path through the flow control member.

The present invention also provides a closure as described herein in combination with a container.

Some aspects and embodiments of the present invention relate to a two-piece flow control solution in which one part moves inside another. One of the parts may be a base component. The base may comprise a dispensing orifice. The other of the parts may be provided inside the base. The movable part may be resiliently biased to block a dispensing path and movable (for example under the influence of increased pressure in an associated squeezable container) to unblock the path. Alternatively or additionally the movable component may comprise one or more dispensing orifices.

The movable part may comprise one or more spring fingers.

The movable part may comprise a sealing surface/flange/bead.

The movable part may be movable between a closed/sealing position in which product cannot pass through a base orifice, and an open/dispensing position in which product can pass around and/or through the movable part and onwardly to and through a dispensing orifice, for example formed in a closure base.

The movable part may be resiliently biased to the closed/sealing position, for example by one or more spring fingers.

Spring finger/s may be provided at or near the free end of a generally cylindrical skirt of the flow control member. The other end of the flow control member may be a generally frusto-conical head portion, which may correspond to part of a dispensing channel/passageway. The or each spring finger may abut/rest/bend against the end of a dispensing channel formed on the base. In the closed position the finger/s may be in a relaxed position. When dispensing is required positive pressure in the container may be used to move the movable part against the bias of the finger/s. When the pressure is released the spring finger/s move the movable part back to the closed/sealing position.

The base dispensing channel may include an internal sealing/retention bead. In a closed position a sealing flange/bead on the movable part may seal against the base channel bead, held there by spring finger/s so that product cannot flow through the movable part orifice/s. The movable part can be lifted off the bead so that product can flow through and/or around the movable part, into the base channel and out of the base orifice.

Some aspects and embodiments provide a polypropylene design (no TPE or silicone) and may rely on one part moving inside another and resetting via spring fingers.

The flow control system may be a two-piece design. Some embodiments dispense through an orifice.

A further aspect provides a one-piece dispensing closure comprising a base and a lid, the base and the lid are connected by a hinge to allow the lid to move between a closed and an open position with respect to the base, the base includes an integrally formed movable flow control member, the closure further comprises a dispensing channel bearing part including a dispensing orifice, the dispensing channel bearing part is formed integrally with the base and connected thereto by a strap so as to be movable from an as-formed position to an assembled position, in which in the assembled position the flow control member seals the dispensing channel, and the flow control member is movable in use to unseal the dispensing channel.

This design means that the flow control member can be movable with respect to the dispensing channel, allowing to it be able to move in use between sealed and unsealed positions.

The base and the channel bearing part may be connected by a strap hinge to allow the channel bearing part to be folded over and onto the base. Either or both of the base and the channel bearing part may comprise connection means e.g. cooperating snap beads.

The flow control member may be carried on or by one or more spring arms/spokes which bias it to a sealed position with respect to the dispensing channel. In use, product pressure may cause the member to move against the bias of the arms to lift it and unseal the channel/passage. When product pressure is released the arm/s pull the member back down to seal the passage. The flow control member and the dispensing channel may be provided with cooperating sealing surfaces, such as sealing beads.

A further aspect provides a dispensing closure comprising a base and a lid, the base includes one or more flow apertures, the closure further comprises a sealing disc including one or more dispensing apertures, the sealing disc is movable between a sealed position in which the base flow apertures are blocked and an unsealed position in which product can flow through the flow apertures and through the dispensing apertures.

The sealing disc may be provided on or by a different/separate part of the closure and/or a different separate component.

Some embodiments relate to a bi-injected closure. For example a sealing disc may be bi-injected onto a base. In other embodiments the sealing disc is provided by a ring structure e.g. an outer ring with an inner disc. This may be formed using a bi-injection process. Such as ring structure could be formed integrally with the base, or as a separate attachable component.

A sealing disc may be provided as a separate part which is attachable/connectable to a base.

A sealing disc may be formed together with a base. For example a disc may be formed with the base and attached using a strap hinge in an as-formed condition. Subsequently the disc is folded or otherwise moved into position on the base.

In some embodiments the base and the lid are connected by a hinge to allow the lid to move between a closed and an open position Some embodiments relate to a three-part assembly process but don't require any secondary slitting of a sealing disc.

A further aspect provides a bi-injected dispensing closure comprising a base and a lid, the base and the lid are connected by a hinge to allow the lid to move between a closed and an open position, the base includes one or more flow apertures, the Some aspects and embodiments relate to a single piece dispensing system.

One embodiment relates to a two-shot bi-injected design using e.g. TPE/V & PP.

One embodiment relates to a single polymer design e.g. in PP.

Some designs use dual hinges e.g. a strap hinges and/or butterfly hinges and/or snap hinge/s. In-mould closing (e.g. for a strap hinge) and out of mould closing (e.g. for an active hinge) may be used.

Some embodiments have a single hinge and a separate TPE-bearing component that clips or is otherwise attachable to an aperture-bearing part.

Some embodiments provide the same opening function as per a slitted valved closure but the disc orifice seals upon a ring abutment feature.

Examples of aspects and embodiments include:

Single polymer (PP) dispensing closure Fully recyclable

Bi-injected TPE/TPV & PP Single piece dispensing closure Fully recyclable

Single piece dispensing closure with bi-injected insert TPE/TPV/PP Fully recyclable The design "engines" could be adapted to fit, for example, into shower gel, condiment, or other flip top dispensing closure profiles. Sizes could be adjusted to reflect bottle geometry/material and product viscosity, as well as any dispensing requirements.

A further aspect provides a dispensing closure for flowable product, comprising a base and a lid, the base comprises a dispensing spout, the closure further comprises a rigid spigot bearing insert locatable in the spout, the closure further comprising a flexible membrane having one or more dispensing apertures, the membrane seals against the insert so that the spigot blocks the aperture/s, and in use positive product pressure pushes against the membrane to release the seal so that product can flow through the aperture/s.

In some embodiments the insert retains the membrane in the spout. For example the membrane may fit into the spout and the insert clips into the spout to retain the membrane.

In some embodiments the base, the insert and the membrane are all formed separately from each other and assemblage together. In one embodiment, when in the rested position (no pressure applied to the pack or membrane) the flexible membrane sits upon and deforms to the contours of the rigid retention disc and central spigot feature seated underneath the flexible membrane.

The membrane may, for example, be constructed of a TPE type material, whereas the retention disc may be produced in HDPE or PP.

Upon the application of positive pressure to a pack, the internal product flows towards the membrane through the annual holes within the rigid retention disc to the membrane Whilst the positive pressure is maintained upon the pack, the product pushes against the flexible membrane to release the "interference" seal on the central spigot feature.

Once the interference seal is broken, the product can flow over the central spigot and through the central hole within the flexible membrane component.

Once the pressure is released the product will cease to flow and the flexible membrane will return to its relaxed "seated" position and recreate the seal preventing any leakage of product.

Once the entire pack has been emptied, this device can be disposed of and completely recycled through standard typical recycling methods and processes.

A further aspect provides a dispensing closure comprising a base with a dispensing passage, the dispensing passage includes a blocking member, the closure further comprising a separate orifice-bearing insert which is attached or attachable to the base so that in a resting position the blocking member blocks the orifice, the orifice-bearing insert is movable to a dispensing position to move the orifice away from the blocking member.

The blocking member may be static.

The blocking member may, for example, be a stud supported in the dispensing passage/channel by arms/spokes.

In some embodiments the insert can be push fitted into the base, for example from above.

The insert may be movable under the influence of product pressure.

The orifice may be provided in a deformable disc, the disc can deform to move the orifice away from the blocking member. Movement of the insert may be constrained to be only by the disc.

The insert may be sealingly receivable in the base.

The disc may be an inverted generally frusto-conical structure with a generally central aperture, for example an inclined/dished annular wall leading to an opening.

The insert may include a sealing skirt around the (e.g. depending from the underside of a disc).

The insert may include one or more supporting legs. The legs may include inclined feet that can pass into the dispensing channel upon assembly and then engage under a free end of the channel to secure the insert into position.

One or more connecting/sealing/snap beads may be provided.

A further aspect relates to a flow control insert for defining an orifice in a dispensing closure. The insert may be fitted into, and retained within, a dispensing closure.

A dispensing closure is one which is typically held in place on, and associated with, the mouth of a container. It has an orifice which is associated with the orifice in the container such that the contents of the container may only be dispensed via the orifice in the closure. Such dispensing closures typically also comprise a lid which may be hinged to the dispensing closure and which may be formed integrally therewith (known, for example, as a flip-top dispensing closure). The purpose of the lid is to seal the orifice in the closure so that, in the closed position, no product may be dispensed whether deliberately or accidentally.

The present invention may provide a flow control insert which is manufactured with a plurality of dispensing slits that define petals formed in an open position. The insert includes an energizing ring for causing closing of the petals/slits upon assembly into a dispensing closure.

The energizing ring may be generally V-sectioned.

The energizing ring may be formed at or near to the base of the petals.

The energizing ring may be a complete annulus, or may comprise arcuate ring sections (e.g. one for each petal).

In some embodiments the petals are substantially completely closed, for example so as to form a seal. In other embodiments the petals are partially closed; a full seal may then, for example, be provided when the closure is in a closed position (e.g. a lid may complete the seal when closed). The present invention may provide an insert for a dispensing closure of the type having a housing with engagement means adapted to receive a flow control insert. The insert may have standardized insert engagement means adapted to engage the housing engagement means and thereby to be received/receivable directly into the closure housing in use.

The present invention may provide a single moulded component (moulded in e.g. PP, PE, TPE, TPS).

The insert may be configured to fit into the same closure retention features as per existing flow control inserts.

The insert may provide a cheaper (and possibly less functional) dispensing "baffle".

Some embodiments provide a TPE/TPS non-valve flow restrictor.

Some embodiments relate to a method of providing a flow control insert, for example including the steps of: I—injection moulding the design with the slits open i.e. not slit after moulding and including an energizing ring; and 2—using a closure to offer a positive pressure/pressing force against the energizing ring to close the slits upon assembly with the closure.

In some embodiments, therefore, the idea is to mould the valve slits open and then use the closure to close the petals using an energizing ring.

The present invention may provide an insert which, when assembled to the closure housing, closes the open petals to form the seal. The design may be a single piece moulding with a central hole plugged by the lid spigot.

The insert may be produced with a standard outer size so that it fits standard engagement features on a dispensing closure.

For example the insert may be designed to fit into the same closure retention features as used by existing inserts, such as those described in WO2006/021509 or WO2008/00 I035.

In one embodiment, the insert engaging means may include a bead projecting radially outward from an exterior wall for snap-fitting the insert into the dispensing closure.

The bead for snap-fitting may be arranged so that it seals against the dispensing closure so that the product only passes through the orifice of the insert and not around the sides. Alternatively and/or additionally, the insert could be glued, welded and/or retained in the closure by other means.

The insert may include an inner sealing bead projecting axially outward from an exterior wall for providing a seal between the insert and closure in use.

Alternatively and/or additionally, the insert may include means to locate the insert in a closure in use, wherein the means project axially outward from an exterior wall of the insert. The locating means may provide a seal against the closure, in use.

The insert may be produced from plastics, which in one embodiment are injection moulded.

In another aspect, the invention provides a combination of a dispensing closure and an insert comprising one or more of the features described herein.

The present invention also provides a flow control insert for a dispensing closure, the insert has a plurality of dispensing slits that define petals, the petals are formed in an open position, an energising ring is provided on or by the insert, in which the petals are closed upon assembly into a dispensing closure.

The present invention also provides an insert for a dispensing closure of the type having a housing with engagement means adapted to receive a flow control insert, the insert has standardized insert engagement means adapted to engage the housing engagement means and thereby to be received/receivable directly into the closure housing in use, the flow control insert has a plurality of dispensing slits that define petals formed in an open position, in which the petals/slits are at least partially closed upon assembly into the dispensing closure.

In some embodiments the insert is a single moulded component.

The insert may, for example, be moulded in PP, PE, TPE or TPS.

The present invention also provides a flow control insert for a dispensing closure, the insert has a plurality of dispensing slits that define petals, in which the petals are formed in an open position, and in which when assembled into the closure the petals are at least partially closed.

The insert may consist of a single piece moulding.

The insert may have a central hole pluggable by a closure spigot in use. The present invention also provides, in combination, a dispensing closure and an insert as described herein.

The present invention also provides a flow control insert which is assemblage into a dispensing closure, the insert comprises a single moulding, the insert has one or more dispensing slits movable between an open position and a closed position, the slit/s are moulded in an open position, in which the slits are moved to the closed position by the action of assembling the insert into the closure and thereafter are movable to the open position by the action of product flow.

In some embodiments radial compression is required during assembly to close petals. Alternatively or additionally vertical/axial compression is required during assembly to close petals.

In some embodiment the closure deforms the insert to close the petals/slits.

The present invention also provides a method of providing a flow control insert, including the steps of: 1—injection moulding an insert with the slits open i.e. not slit after moulding; and 2—using a closure to offer a positive pressure against the open slits to close them upon assembly to the closure.

The present invention also provides a method of providing a dispensing closure with a flow control insert, comprising the steps of: i) injection moulding an insert with a plurality of petals formed in an open position; and ii) providing a dispensing closure; and iii) using the closure to offer a positive pressure against the open petals to close them upon assembly to the closure.

The present invention also provides a closure having an insert as described herein.

The present invention also provides a container in combination with a closure as described herein.

Closures as described herein in combination with containers are also contemplated.

Different aspects and embodiments of the invention may be used separately or together.

Further particular and preferred aspects of the present invention are set out in the accompanying independent and dependent claims. Features of the dependent claims may be combined with the features of the independent claims as appropriate, and in combination other than those explicitly set out in the claims. Each aspect can be carried out independently of the other aspects or in combination with one or more of the other aspects.

The present invention will now be more particularly described, by way of example, with reference to the accompanying drawings. Example embodiments are shown and described in sufficient detail to enable those of ordinary skill in the art to embody and implement the systems and processes herein described. It is important to understand that embodiments can be provided in many alternate forms and should not be construed as limited to the examples set forth herein.

Accordingly, while embodiments can be modified in various ways and take on various alternative forms, specific embodiments thereof are shown in the drawings and described in detail below as examples. There is no intent to limit to the particular forms disclosed. On the contrary, all modifications, equivalents, and alternatives falling within the scope of the appended claims should be included. Elements of the example embodiments are consistently denoted by the same reference numerals throughout the drawings and detailed description where appropriate. The robot is not limited in the design and shape of the structure shown in the drawings.

The terminology used herein to describe embodiments is not intended to limit the scope. The articles "a," "an," and "the" are singular in that they have a single referent, however the use of the singular form in the present document should not preclude the presence of more than one referent. In other words, elements referred to in the singular can number one or more, unless the context clearly indicates otherwise. It will be further understood that the terms "comprises," "comprising," "includes," and/or "including," when used herein, specify the presence of stated features, items, steps, operations, elements, and/or components, but do not preclude the presence or addition of one or more other features, items, steps, operations, elements, components, and/or groups thereof.

Unless otherwise defined, all terms (including technical and scientific terms) used herein are to be interpreted as is customary in the art. It will be further understood that terms in common usage should also be interpreted as is customary in the relevant art and not in an idealized or overly formal sense unless expressly so defined herein.

Referring first to FIGS. 1 and 2 there is shown dispensing closure 5 formed according to an aspect of the present invention. The closure 5 comprises a base 10 and a lid 15. The base 10 and lid 15 are joined by a hinge 20.

The base 10 includes a top deck 25 with a depending sidewall 30.

The top deck 25 is provided with a dispensing orifice 35 defined by an annular wall 40. The wall 40 continues to a frustoconical wall section 42 and a J-shape connecting wall section 44 that connects to the top deck. Four (in this embodiment) abutment projections 43 depend from the underside of the wall section 42. Radially outwards of the orifice, a dispensing channel sidewall 45 is provided and depends from the top deck. The sidewall 45 terminates with an open end 46. In advance of the end 46 a sealing bead 47 is provided and extends inwardly from the interior of the sidewall 45.

Referring now also to FIG. 3, a flow regulating insert 50 is provided. The insert 50 comprises a frustoconical head 52 from which depends four (in this embodiment) legs 54. Each of the legs 54 carries a spring foot 55. The head 52 includes an annular sealing bead 53.

The insert 50 is fitted into the dispensing channel sidewall 45 so that the insert head bead 53 passes over the sidewall sealing bead 47. The spring feet 55 engage against the sidewall end 46 as shown in FIGS. 1 and 2. In this position the beads 47, 53 seal against each other, which in use prevents fluid from flowing through the dispensing channel to reach the orifice 35.

The closure 5 is connectable to a squeezable container filled with product (not shown) to form a pack.

Upon the application of positive pressure to the pack, the internal product flows towards dispensing channel.

Whilst the positive pressure is maintained upon the pack, product pushes against the insert 50 (there are no apertures in the insert in this embodiment). This causes the spring feet to flex so that the insert moves (axially "upwards" within the dispensing channel). This releases the seal between the beads so that product can pass around the insert to reach the aperture. The insert 50 can move up towards or to the wall section 42, whereupon the head 52 will abut against the spaced projections 43, between which product can flow.

Once the pressure is released the product will cease to flow. The resilient spring feet then pull the insert back down, recreating the seal and preventing any leakage of product.

Figure 1:
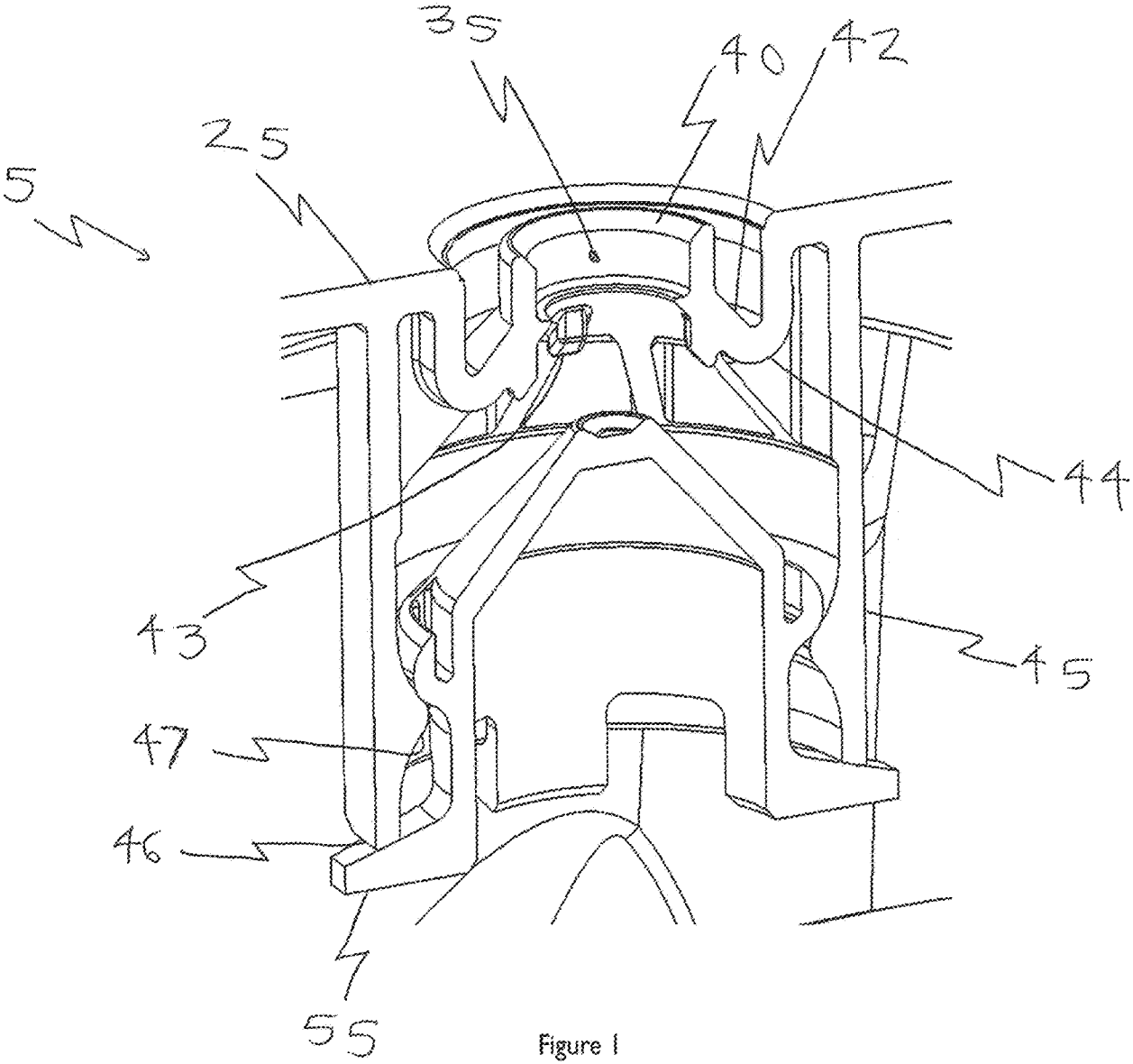
Figure 2:
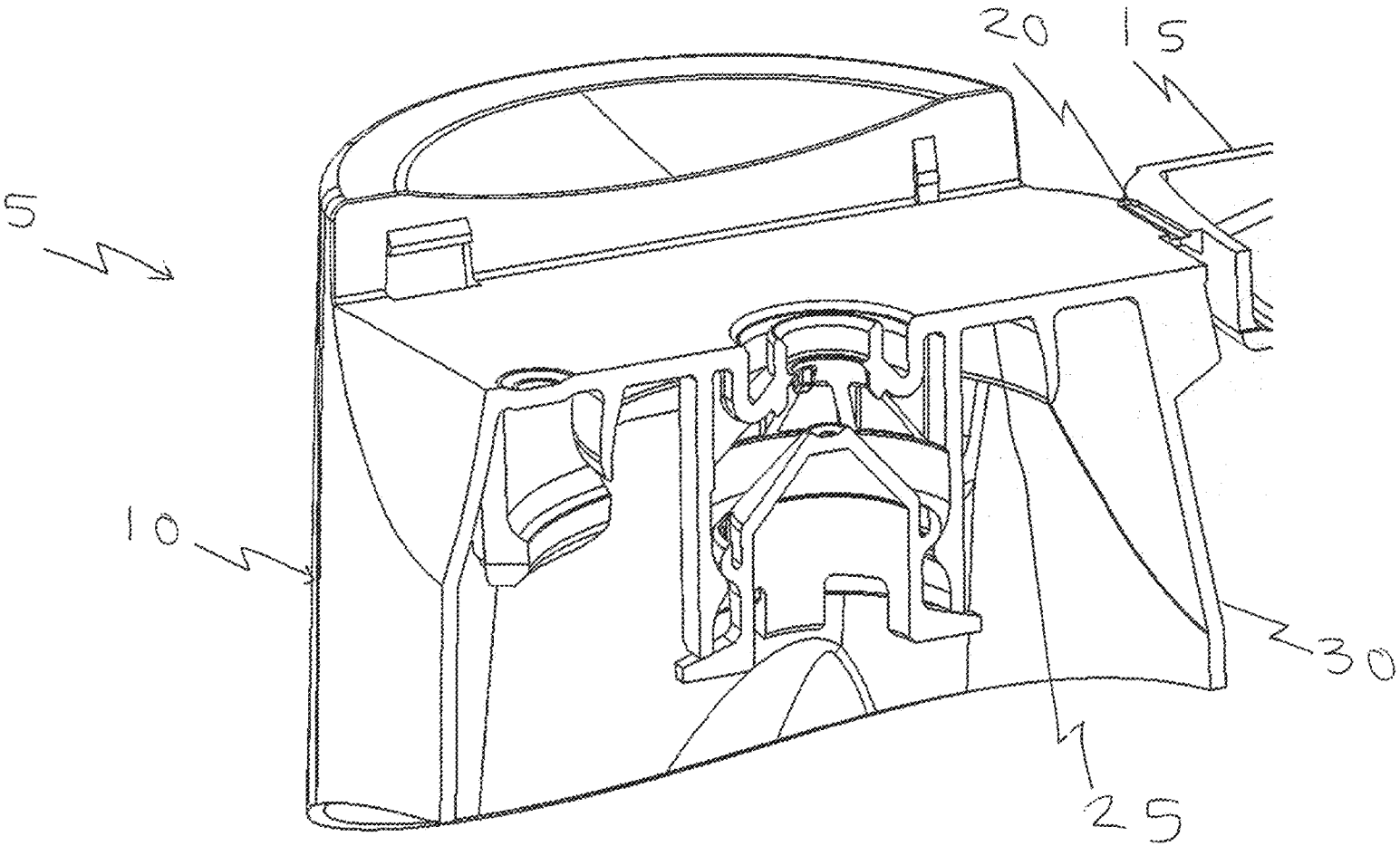
Figure 4:
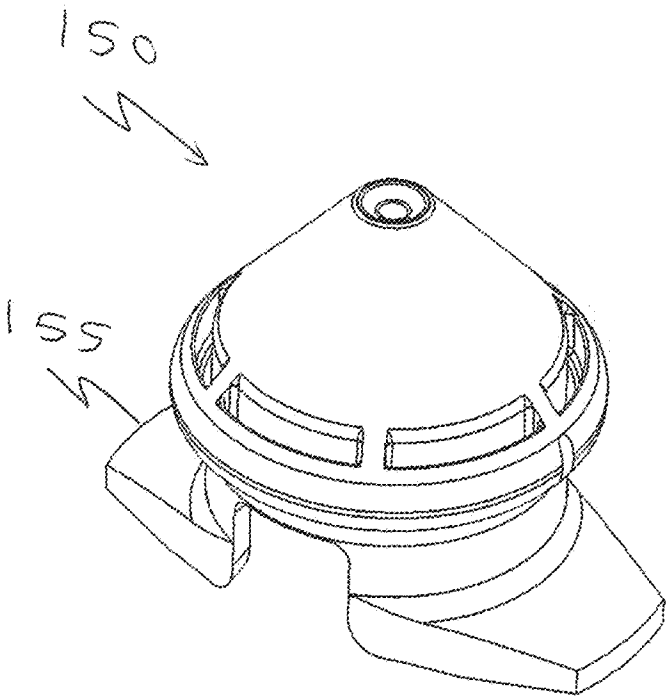
FIG. 4 shows an insert 150 formed according to a further embodiment, having two spring feet 155.
Figure 3:
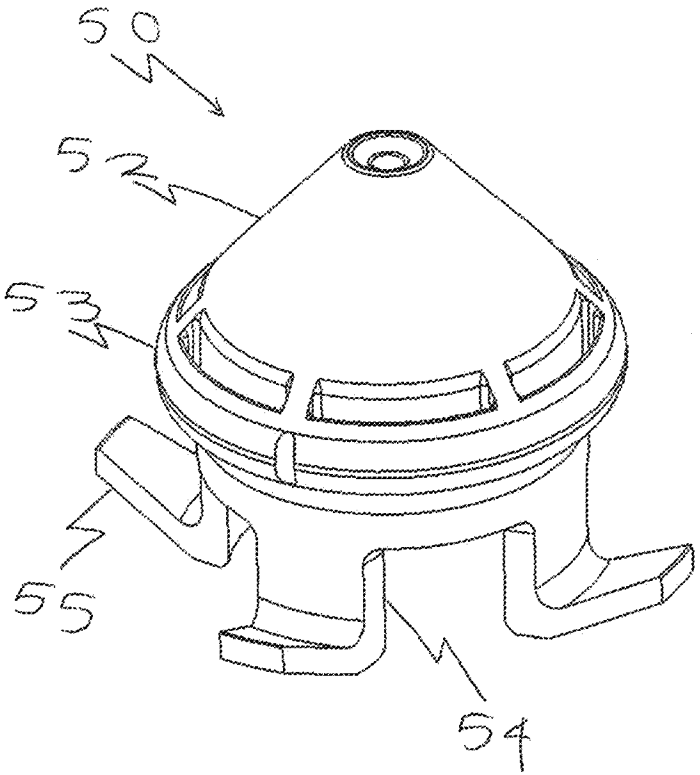
Figure 5:
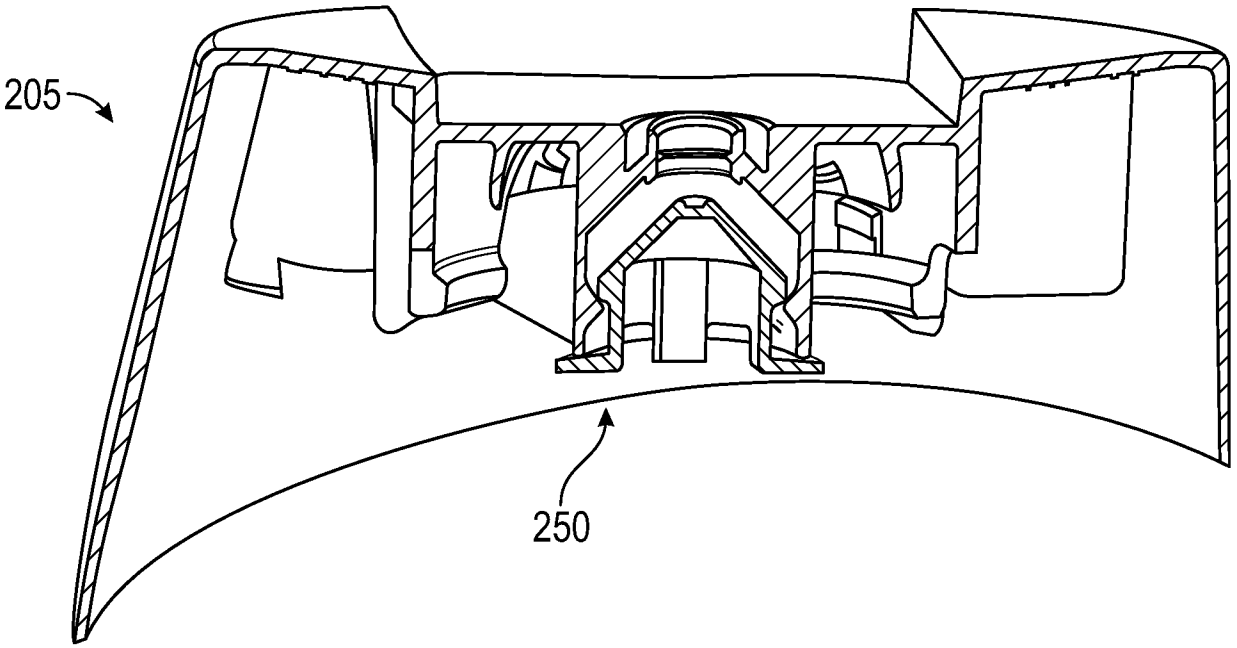
FIG. 5 shows a cut away section of a closure 205 formed according to a further embodiment.
Figure 7:
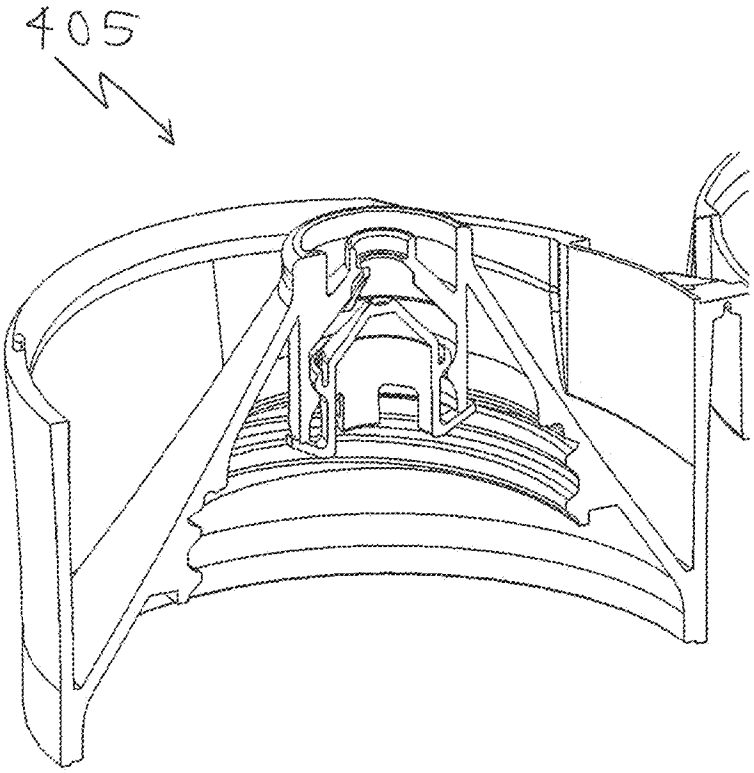
FIG. 7 shows a closure 405 formed according to a further embodiment and based on the same flow control principles of FIGS. 1 to 6.
Figure 6:
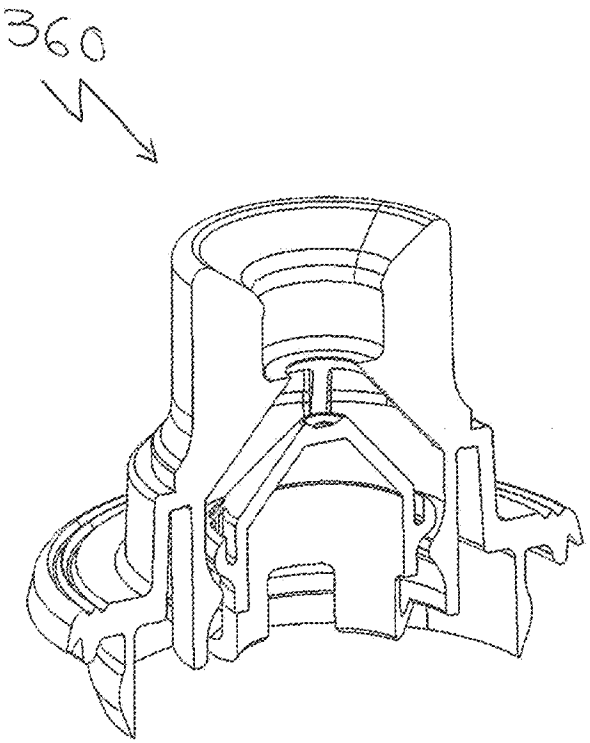
FIG. 6 shows a closure spout 360 formed in accordance with a further embodiment and based on the same general principles as described in relation to FIGS. 1 to 5.
Figure 8:
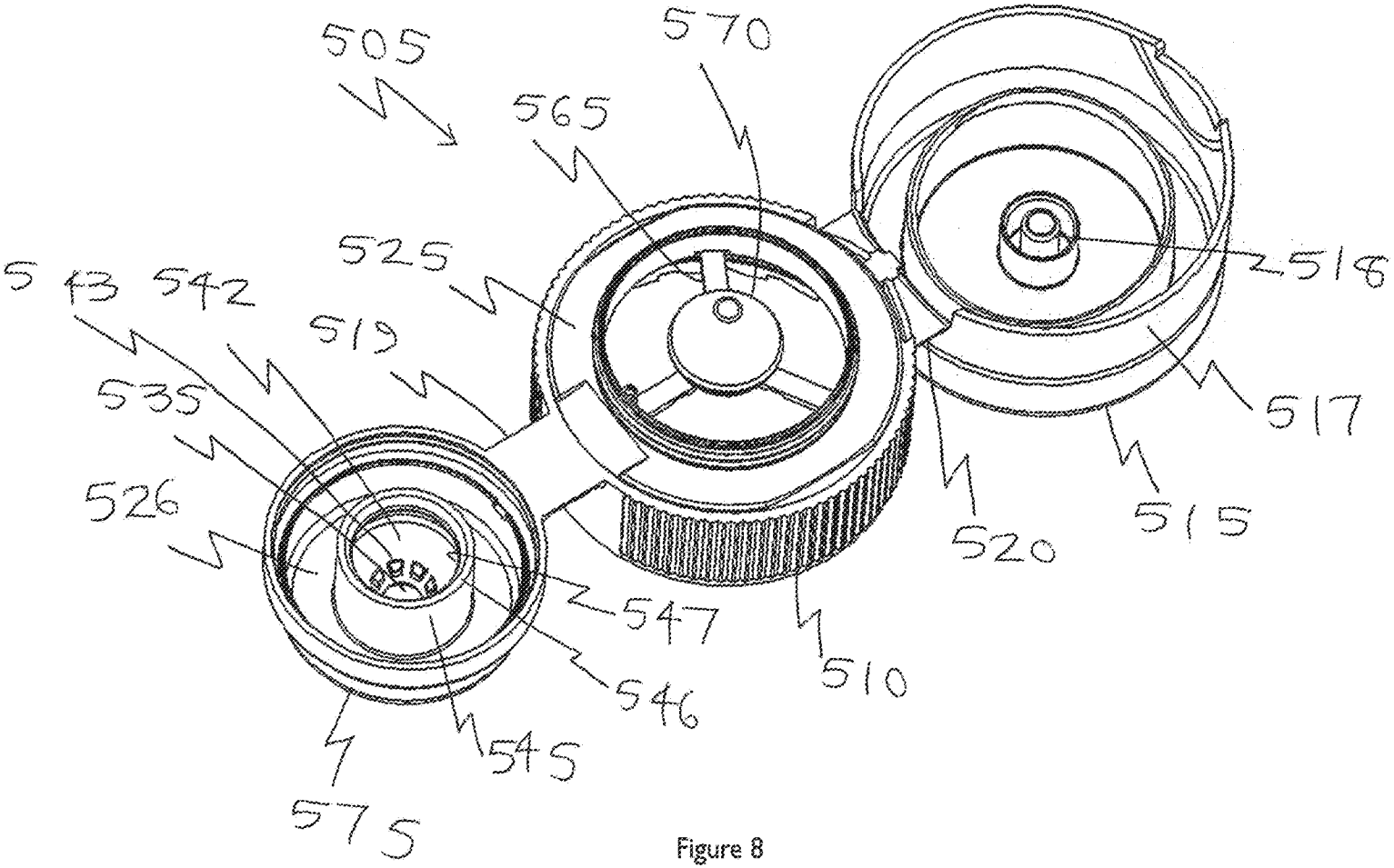
Figure 9:
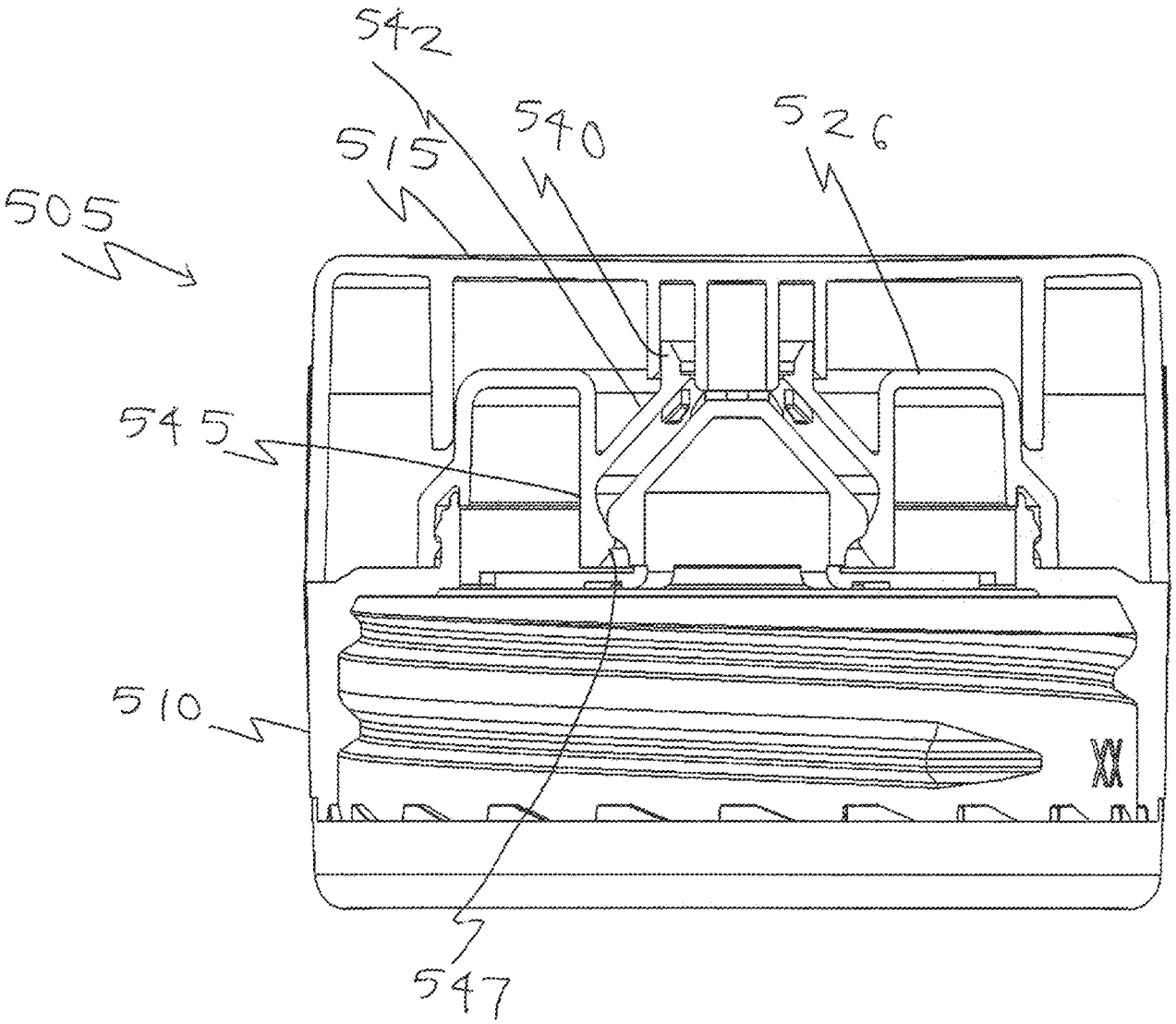

Referring now to FIGS. 8 and 9 there is shown a dispensing closure 505 formed according to a further aspect of the present invention. The closure 505 comprises a base 510 and a lid 515 joined by a first hinge 520.

The base 510 comprises a cylindrical sidewall partially closed at one end by an annular top deck 525. The centre of the top deck is open. Three flexible spokes 565 extend from the deck to support a central, generally frustoconical spigot 570.

The lid 515 includes a top plate 516 from the periphery of which a sidewall 517 depends. At the centre of the top plate 516 a sealing spigot 518 depends.

Attached to the base, generally opposite the hinge, is a strap 519 which in turn connects to a dispensing passage bearing part 575.

The part 575 includes a top deck 526 is provided with a dispensing orifice 535 defined by an annular wall 540. The wall 540 continues to a frustoconical wall section 542 and a connecting wall section 544 that connects to the top deck. Eight (in this embodiment) abutment projections 543 depend from the underside of the wall section 542.

Continuing from the wall section 542 a dispensing channel sidewall 545 is provided. The sidewall 545 terminates with an open end 546. At the end 546 a sealing bead 547 is provided and extends inwardly from the interior of the sidewall 545.

FIG. 8 shows the closure in an as-moulded condition. It will be noted that the closure is formed as a single piece.

To assemble the closure the part 575 is rotated over to engage the base. In this position (FIG. 9) the base spokes/arms are adjacent the open end 546. Operation of the closure is similar to the closure of FIGS. 1 to 7, with the base spigot movable by deformation of the spokes to unblock the dispensing channel.

Figure 10:
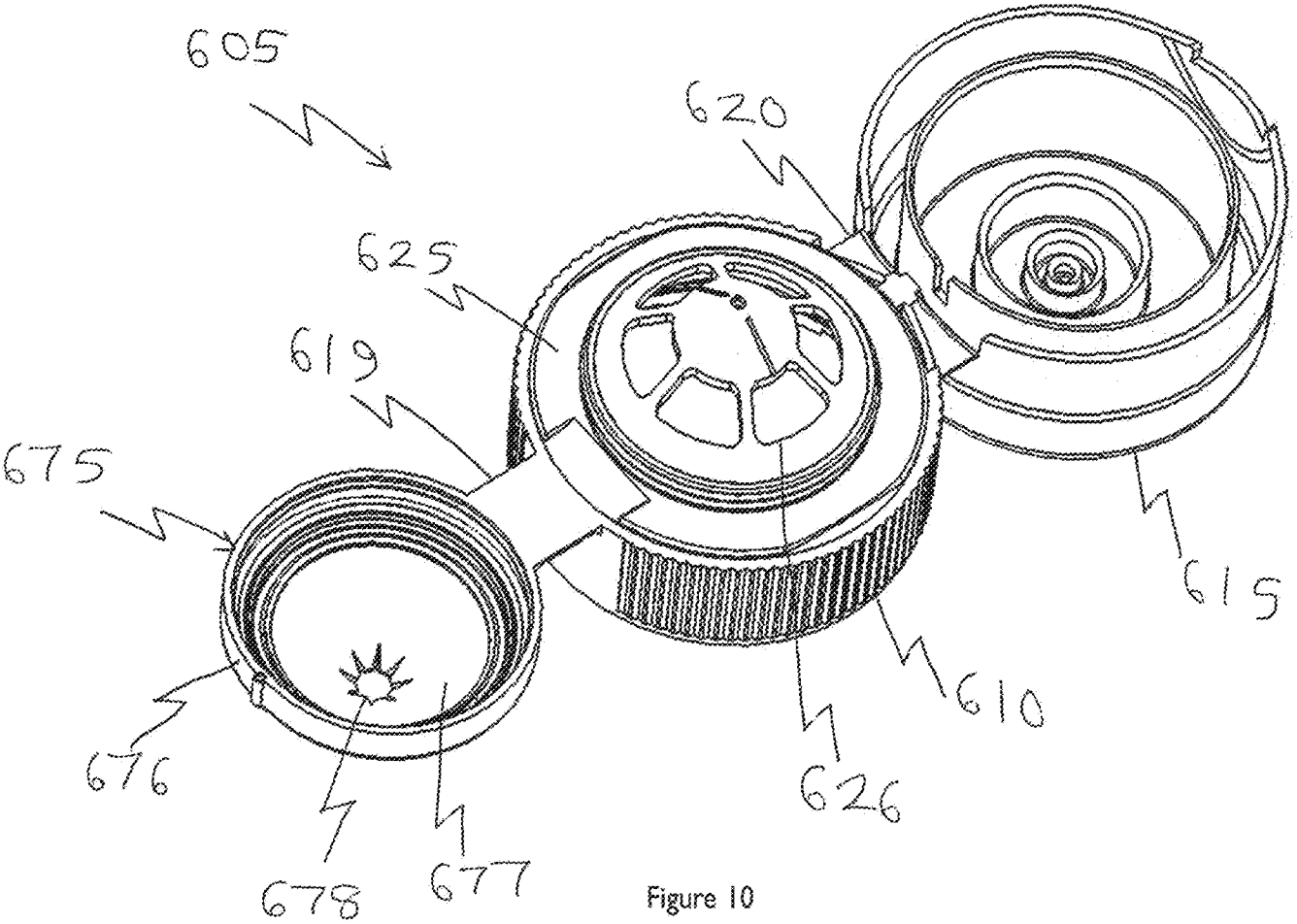
Figure 11:
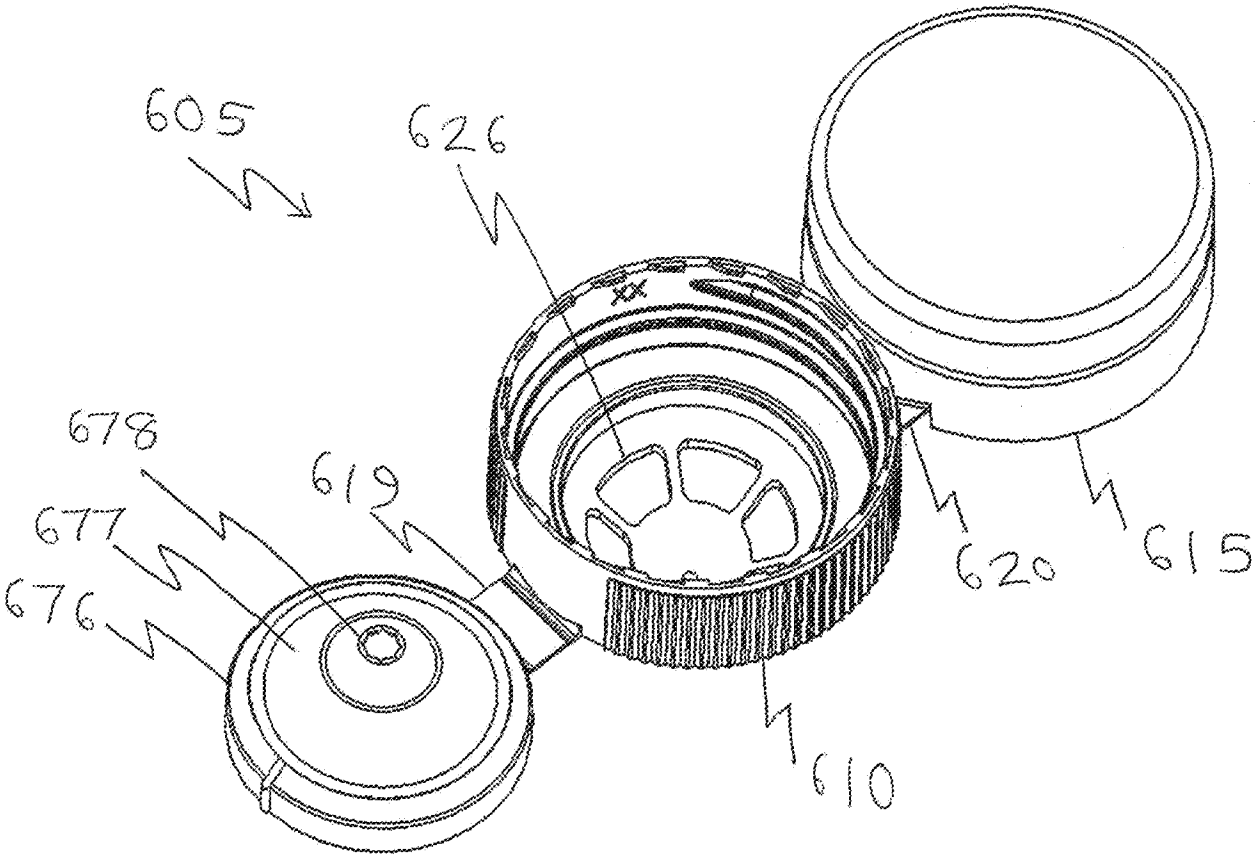

FIGS. 10 and 11 shows a closure 605 formed according to a further embodiment.

The closure 605 comprises a base 610 and a lid 615, joined together by a hinge 620.

The base includes a top plate 625 with a plurality of dispensing apertures 626.

An orifice bearing part 675 is provided and connected to the base by a strap. The part includes a rigid outer ring 676 and an inner flexible sealing disc 677 with a central dispensing orifice 678.

The closure is formed by sequential moulding, with the base, lid, strap and ring formed in a first moulding phase, followed by overmoulding of the sealing disc.

Figure 12:
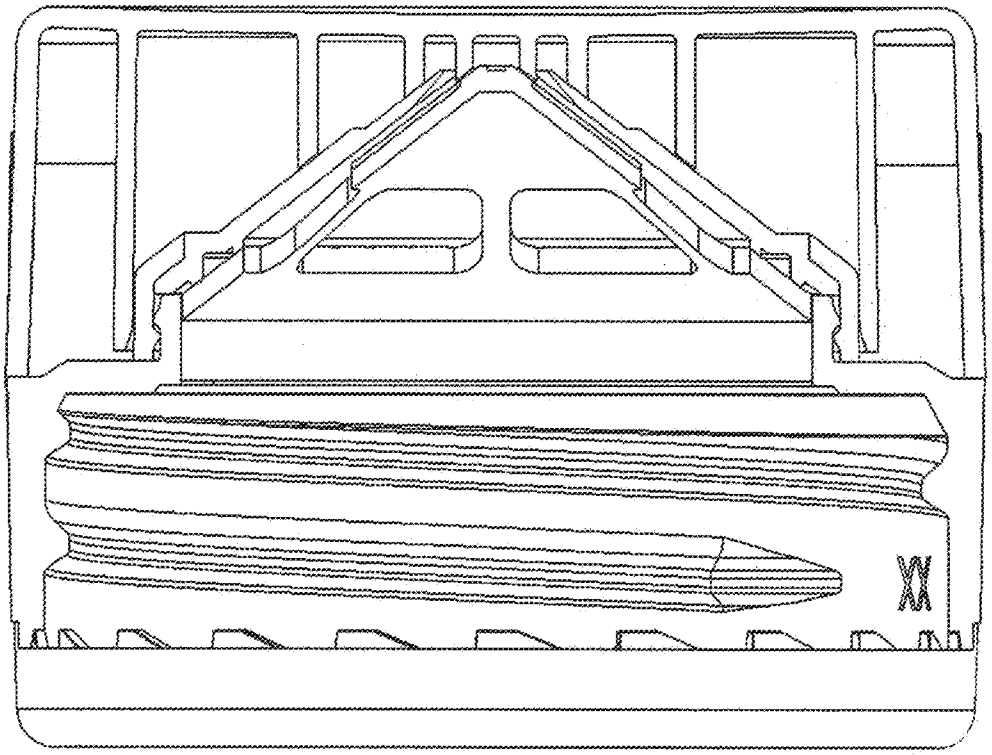

When the closure is assembled (FIG. 12) the part connects to the base, which places the sealing membrane/disc over the apertures. This blocks/seals the apertures.

Product pressure in use causes the membrane to be forced away from the apertures, allowing product to flowthrough the apertures and out of the disc orifice.

Figure 13:
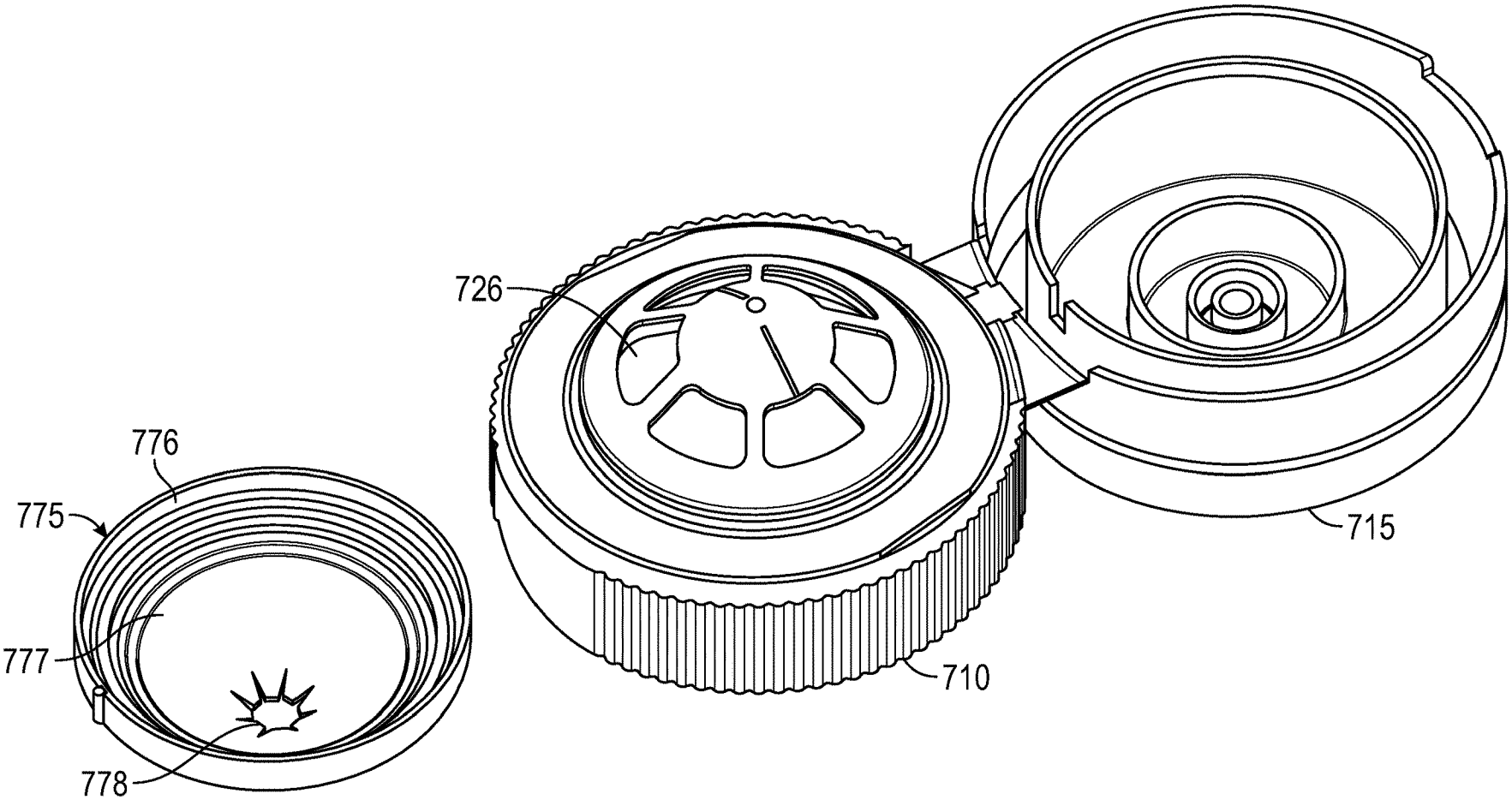
Figure 14:
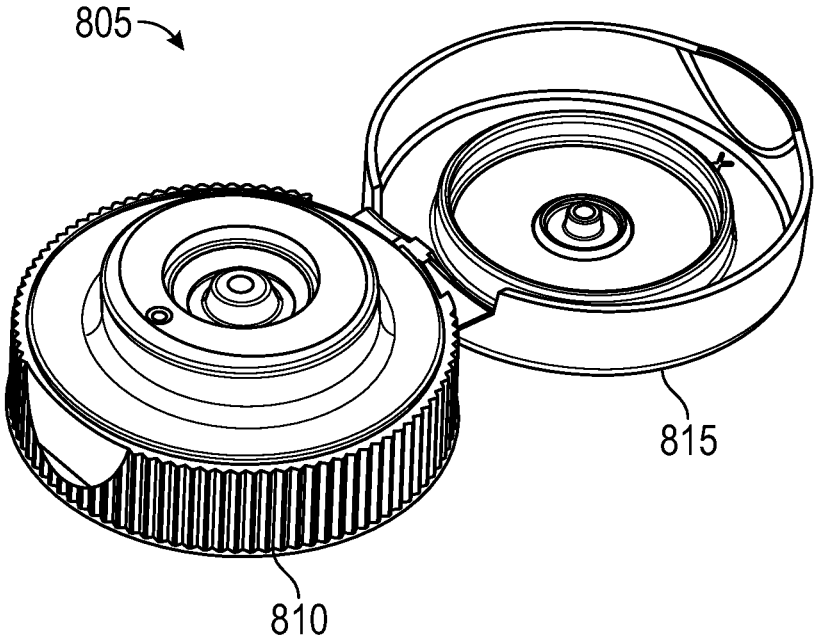
Figure 15:
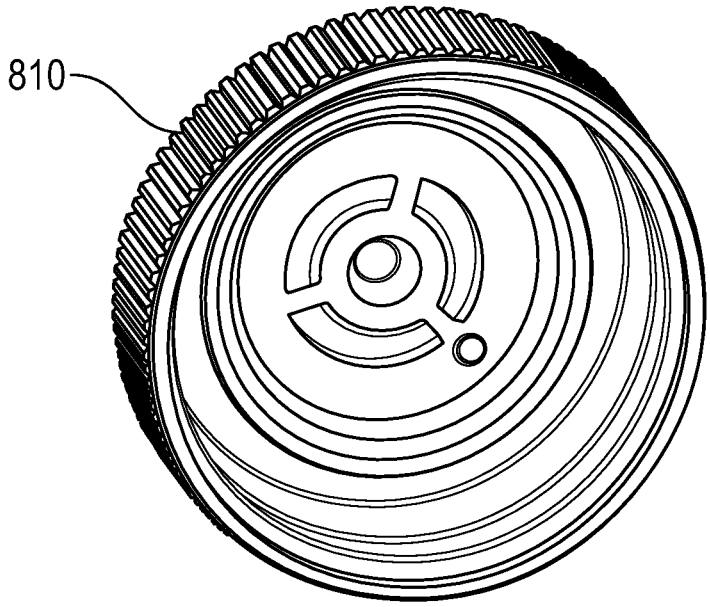
Figure 17:
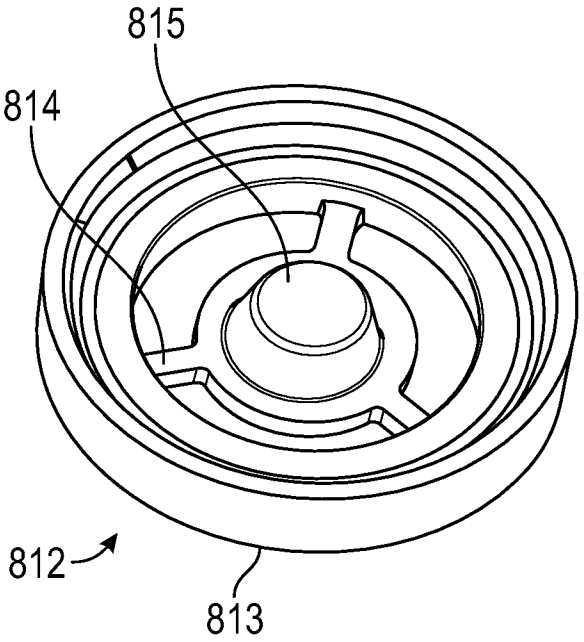
Figure 16:
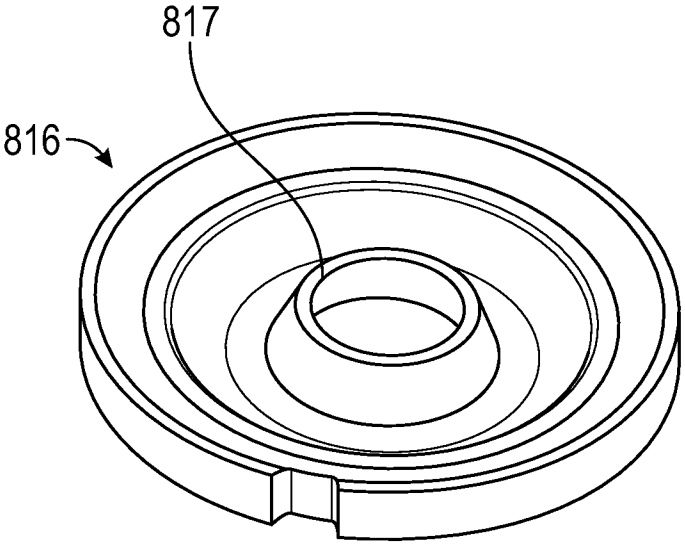
Figure 18:
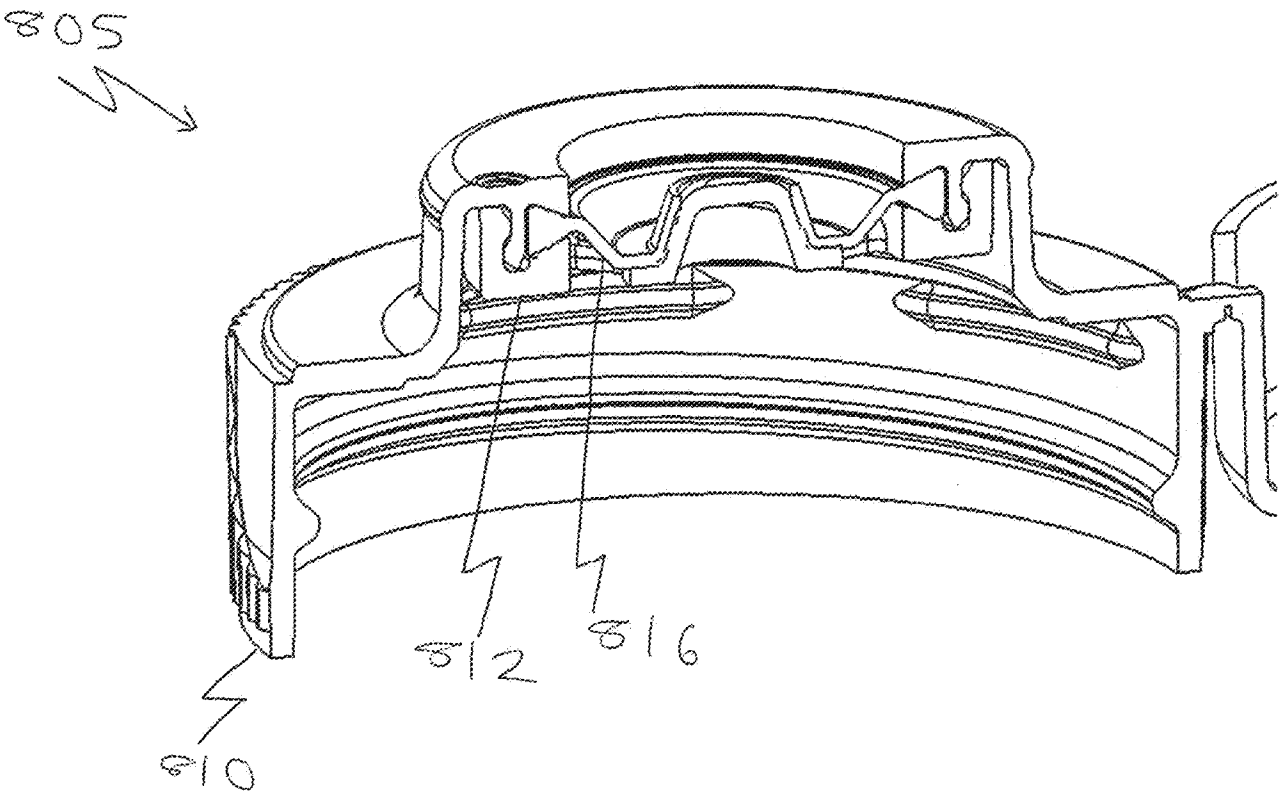

FIG. 13 shows a closure 710 formed according to a further embodiment. The closure is similar to the closure 610. In this embodiment the part is formed separate of the base/lid. It is formed with an outer ring which carries a membrane. The part is assembled onto the base and thereafter the closure 710 functions in a similar way to the closure 610.

FIGS. 14 to 18 illustrate a closure 805 formed according to a further embodiment.

The closure 805 comprises a base 810 and a lid 815.

The base comprises a dispensing spout 811.

The closure further comprises a rigid spigot bearing insert 812 (FIG. 17) locatable in the spout. The insert 812 comprises an outer ring 813 from which extend three spokes 814 that carry a central spigot 815.

The closure further comprising a flexible membrane 816 (FIG. 18) having a central dispensing aperture 817.

When assembled the membrane seals against the insert so that the spigot blocks the aperture, and in use positive product pressure pushes against the membrane to release the seal so that product can flow through the aperture.

The insert retains the membrane in the spout. The membrane fits into the spout and the insert clips into the spout to retain the membrane.

The base/lid, the insert and the membrane formed as three separate components which are assemblage together. When in the rested position (no pressure applied to the pack or membrane) the flexible membrane sits upon and deforms to the contours of the rigid retention disc and central spigot feature seated underneath the flexible membrane.

The membrane is constructed of a TPE type material, whereas the retention disc is produced in HDPE or PP.

Upon the application of positive pressure to a pack, the internal product flows towards the membrane through the annual holes within the rigid retention disc to the membrane Whilst the positive pressure is maintained upon the pack, the product pushes against the flexible membrane to release the "interference" seal on the central spigot feature.

Once the interference seal is broken, the product can flow over the central spigot and through the central hole within the flexible membrane component.

Once the pressure is released the product will cease to flow and the flexible membrane will return to its relaxed "seated" position and recreate the seal preventing any leakage of product.

Once the entire pack has been emptied, this device can be disposed of and completely recycled through standard typical recycling methods and processes.

FIGS. 19 to 24 illustrate a closure 905, 905*a* formed according to a further embodiment.

Figure 19:
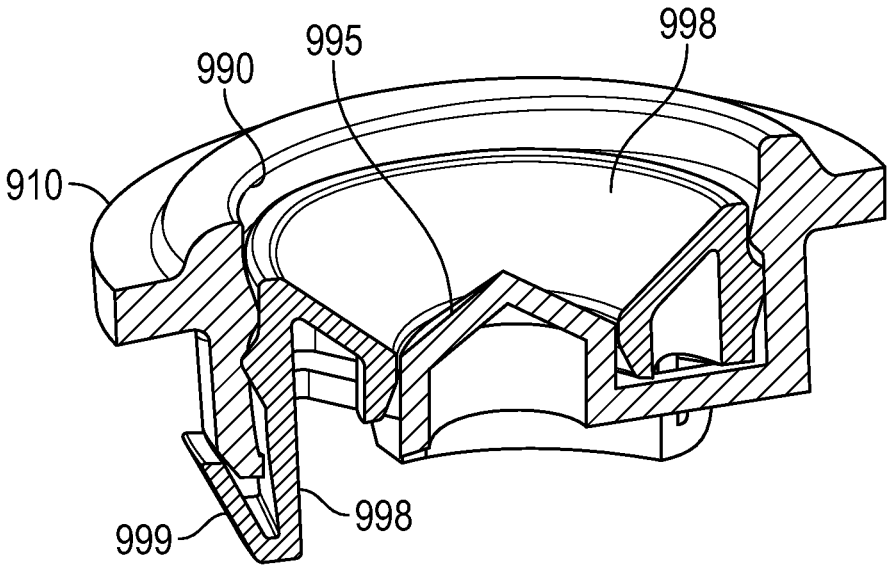
Figure 20:
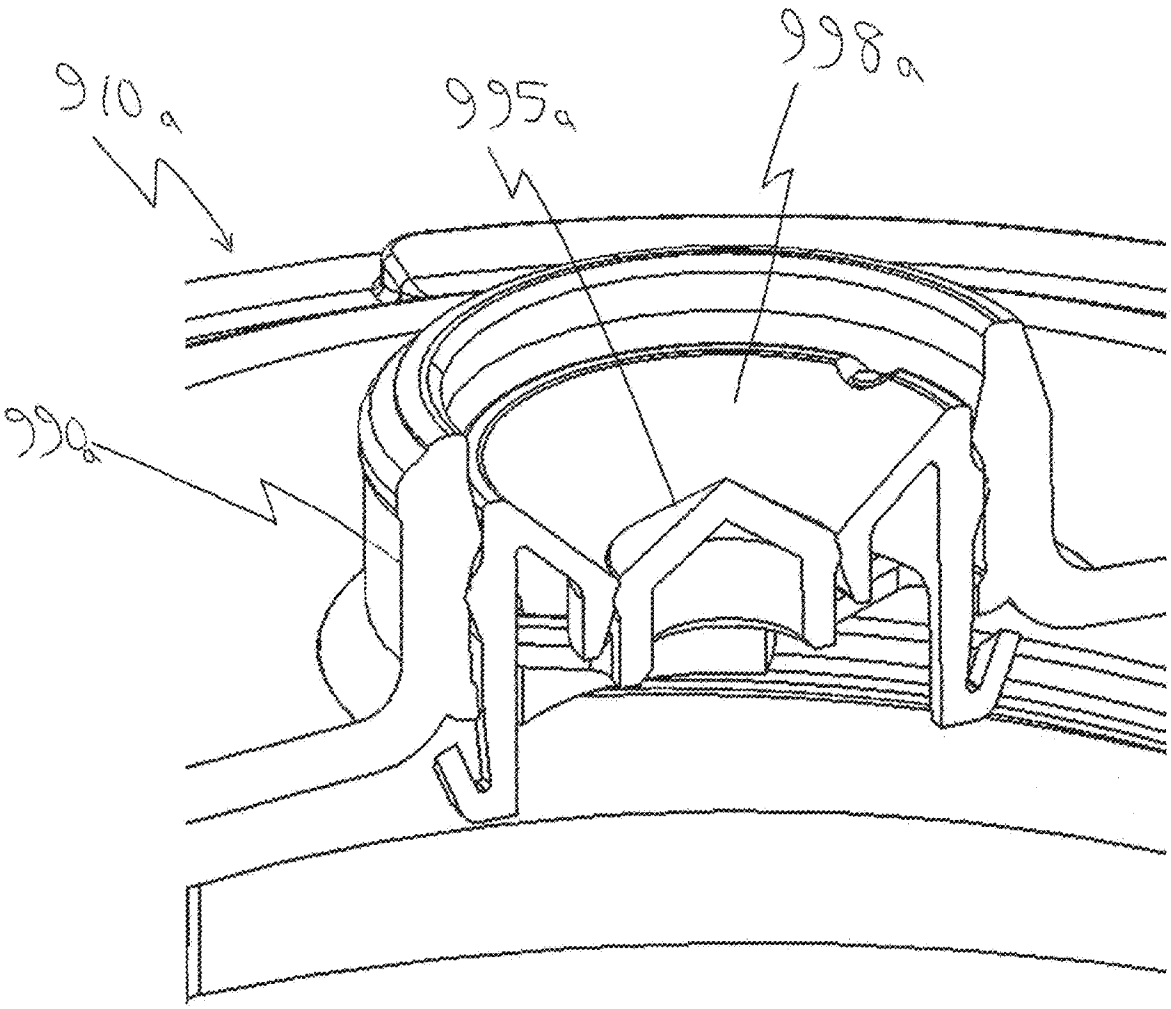
Figure 22:
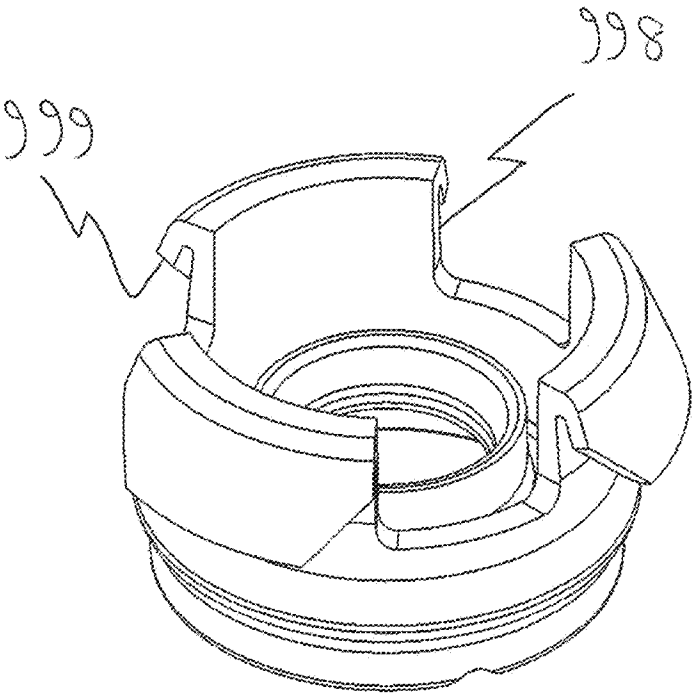
Figure 21:
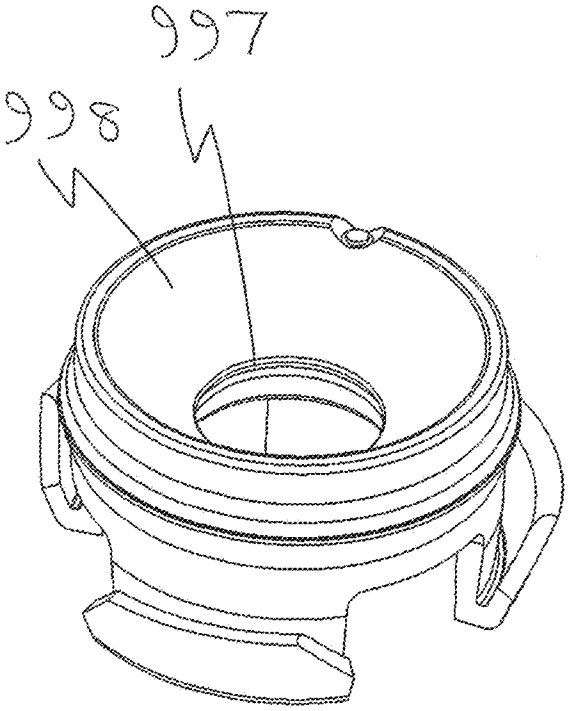

FIGS. 19 and 20 show similar principles. The closure 905, 905*a* comprises a base 910, 910*a* with a dispensing passage/spout 990, 990*a*. The dispensing passage includes a blocking member 995, 995*a*.

The closure further comprising a separate orifice-bearing insert (also see FIGS. 21 and 22) which is attached or attachable to the base so that in a resting position the blocking member blocks the orifice. The orifice-bearing insert is movable to a dispensing position to move the orifice away from the blocking member.

The blocking member is static and in this embodiment comprises a stud supported in the dispensing passage/channel by arms/spokes.

Figure 24:
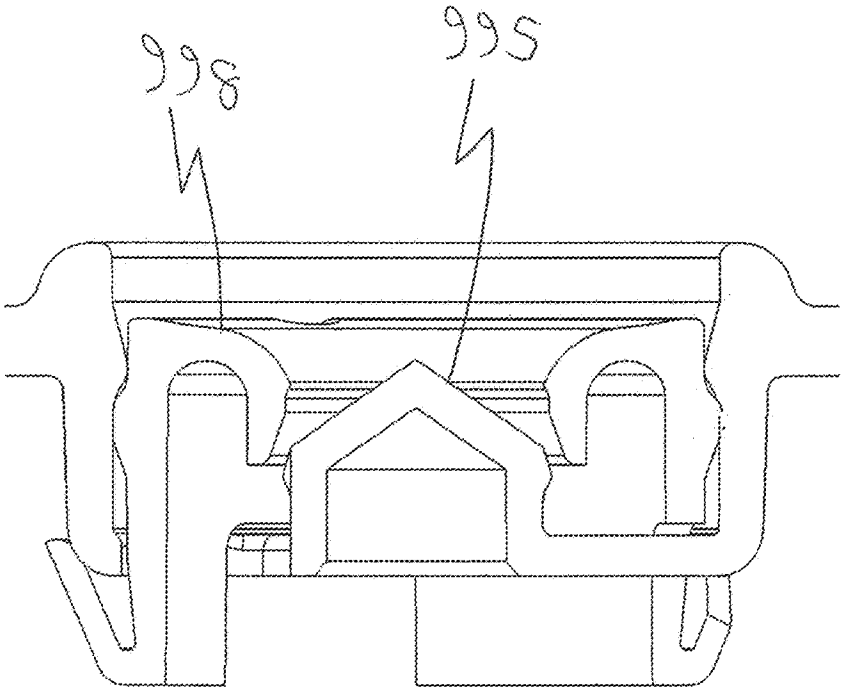
Figure 23:
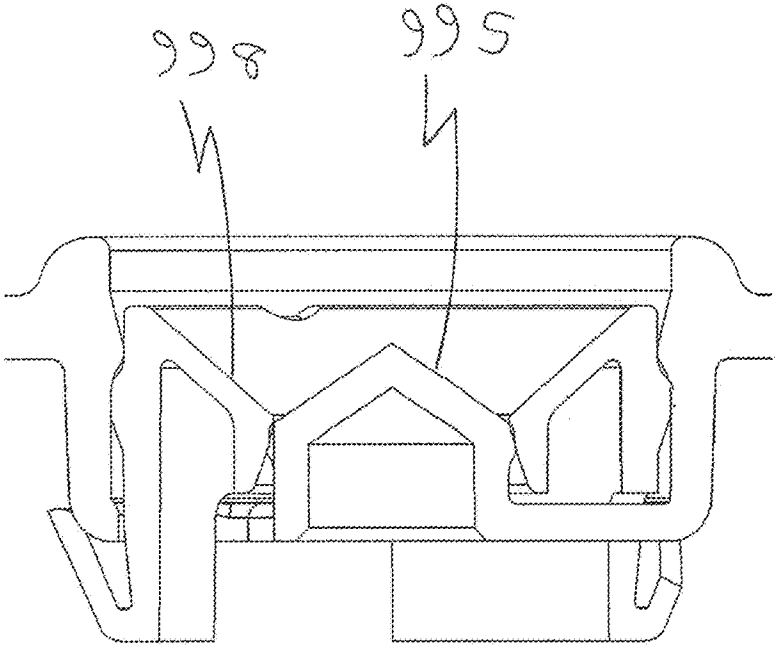

The orifice may be provided in a deformable disc/head 998, the disc can deform to move the orifice away from the blocking member. FIG. 23 shows the disc in a sealed position and FIG. 24 shows the disc having flexed away from the blocking member.

The insert is sealingly receivable in the base. The disc is an inverted generally frusto-conical structure with a generally central aperture 997.

The insert includes a sealing skirt/wall around the aperture, depending from the underside of the disc.

The insert may include one or more supporting legs 998. The legs may include inclined feet 999 that can pass into the dispensing channel upon assembly and then engage under a free end of the channel to secure the insert into position.

Figure 26:
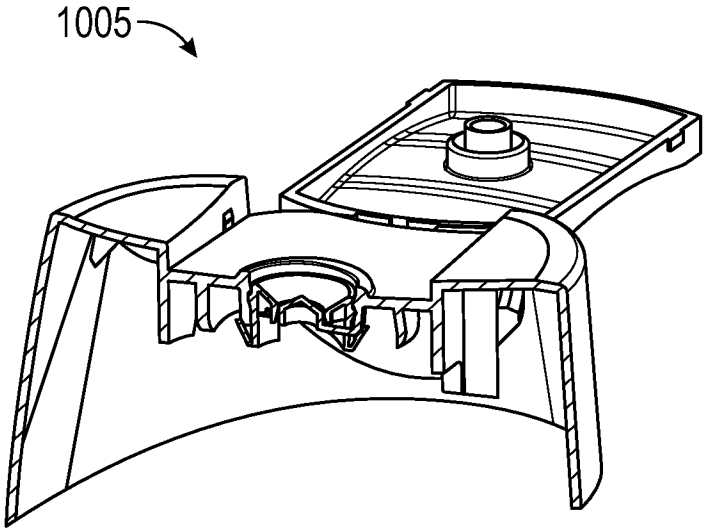
Figure 25:
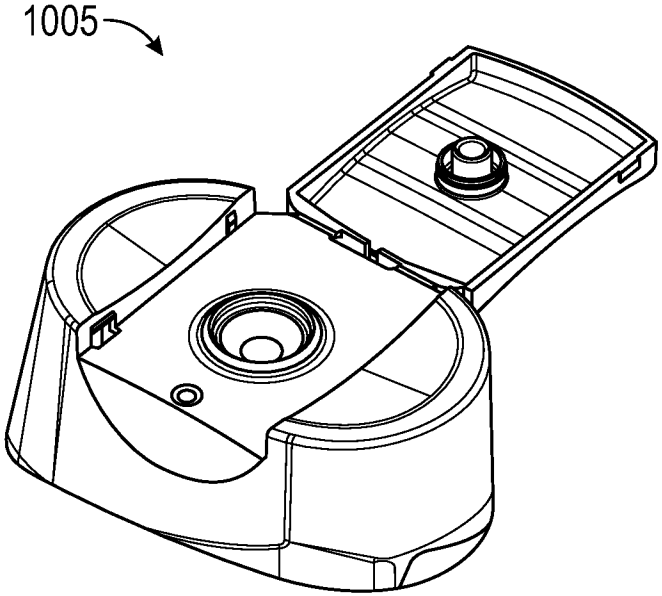

FIGS. 25 and 26 show a closure 1005 formed according to a further embodiment.

Figure 28:
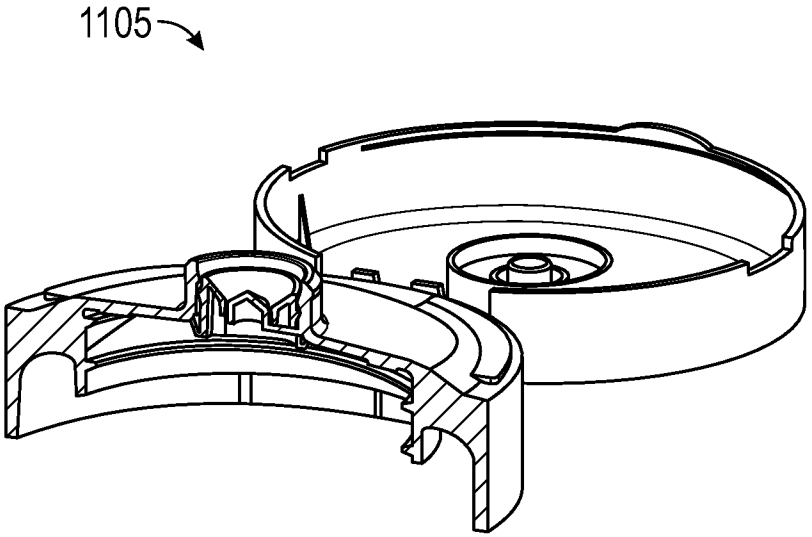
Figure 27:
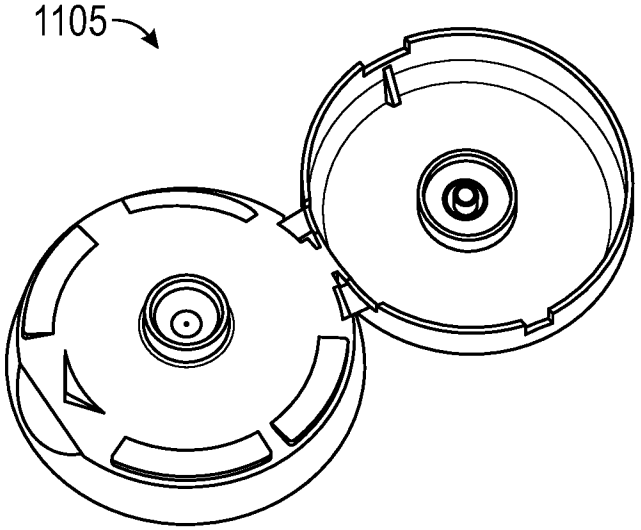

FIGS. 27 and 28 show a closure I 105 formed a closure formed according to a further embodiment.

Figure 29:
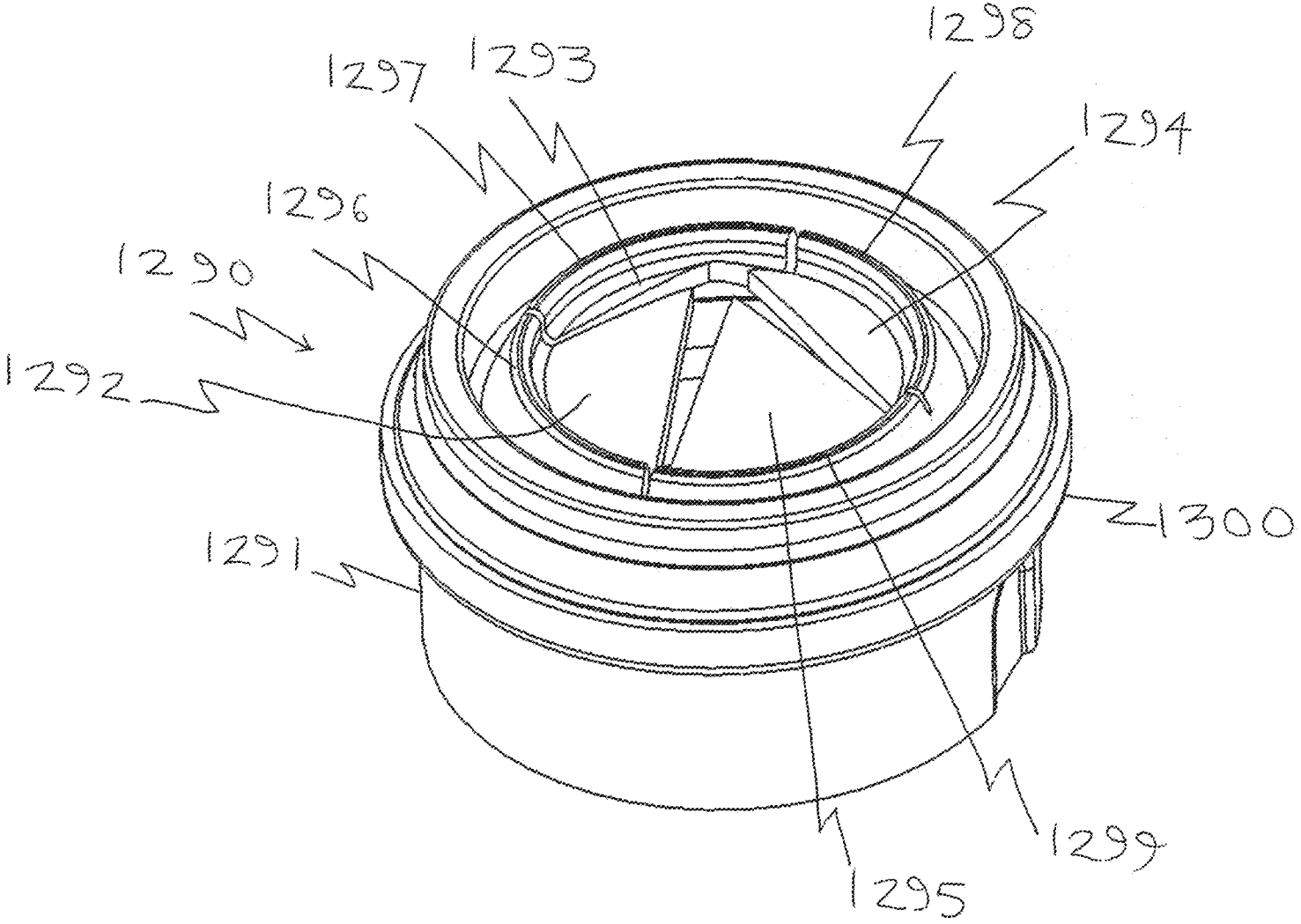
Figure 30:
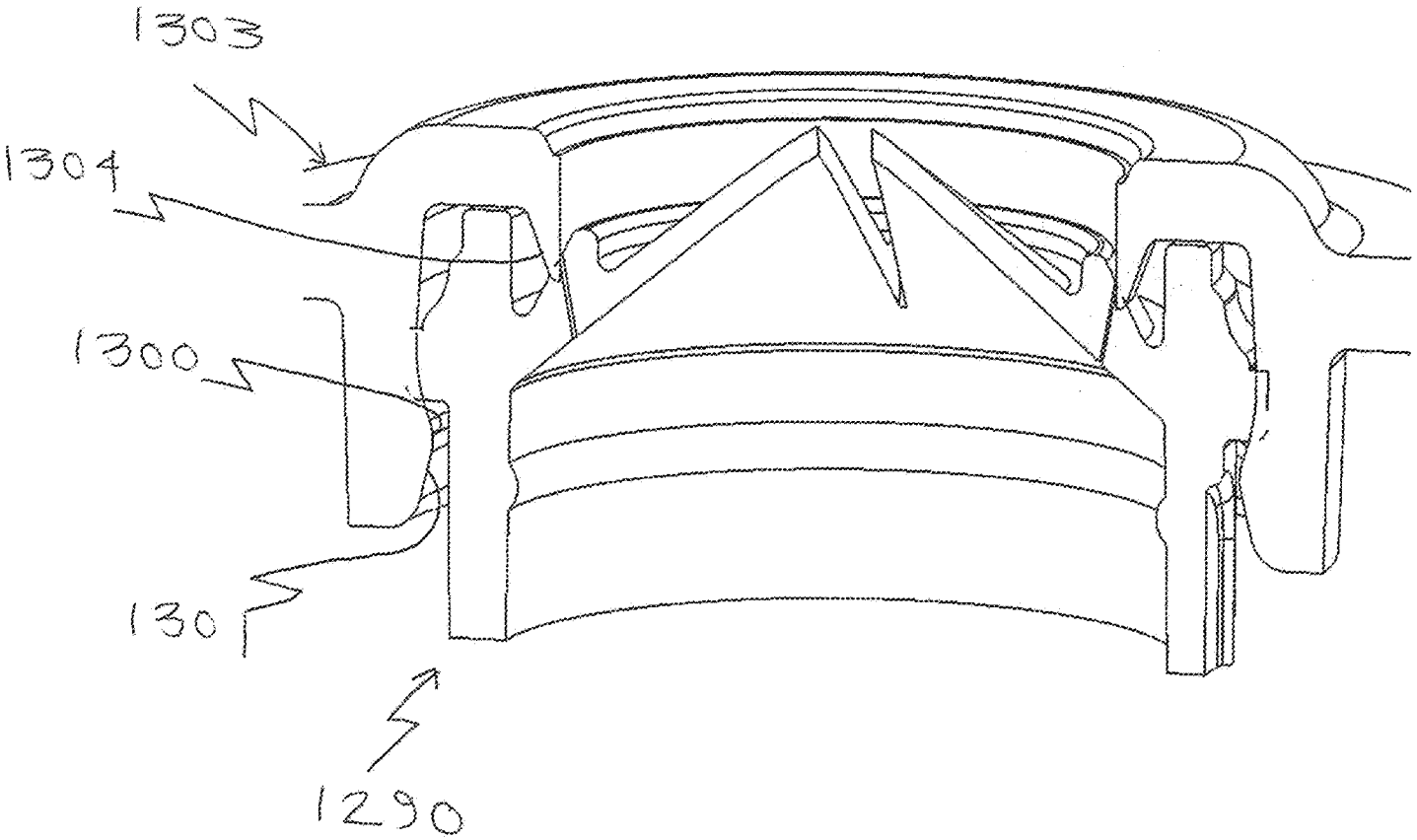

FIGS. 29 and 30 show a dispensing insert 1290 formed according to a further aspect of the present invention.

FIG. 29, for example, shows a one-piece moulded insert with a sidewall 1291. At one end of the sidewall are four generally triangular petals 1292, 1293, 1294, 1295 (in other embodiments different numbers of slits and consequential petals are possible). The petals are formed (e.g. by moulding) in a raised/open position; there is no post-formation slitting operation required to separate the petals (e.g. with slitting).

Associated with each of the petals (in this embodiment generally at the base thereof) is an arcuate energizing ring section 1296, 1297, 1298, 1299.

The geometry of the insert in the as-moulded condition is selected so that when the insert is inserted into the closure, and radially and/or axial inward pressure is applied to the insert head by the closure, the petals close to provide a seal.

Referring now to FIG. 30, in this embodiment a snap-fit seal is achieved between the insert sealing bead 1300 and a corresponding projection 1301 on the surface of an inner radial wall 1302 of a dispensing closure 1303. The closure has a depending annular projection 1304 which engages the energizing ring sections when the insert is assembled into the closure. This helps to close the petals/flaps.

In this embodiment the surface of the inner radial wall of the closure is formed so as to help retain the insert in place. This is achieved by the inner radial wall having a reduced diameter at the lower end such that the insert has to be forced past this reduced diameter before reaching the section of the closure which has a slightly greater diameter. The diameter of the section of the closure, which is slightly reduced in diameter, is less than the maximum diameter of the insert (as measured in the plane of the annular sealing bead).

Once in position the insert may function in the same way as a typical self-closing valve (formed by post-moulding slitting) i.e. when the container is squeezed the product is forced through the slits of the insert which open in response to the increase in pressure within the container.

Although illustrative embodiments of the invention have been disclosed in detail herein, with reference to the accompanying drawings, it is understood that the invention is not limited to the precise embodiments shown and that various changes and modifications can be effected therein by one skilled in the art without departing from the scope of the invention as defined by the appended claims and their equivalents.

The invention claimed is:

1. A dispensing closure for flowable product, the dispensing closure comprising a base and a lid, wherein the base comprises a dispensing spout, the closure further comprises a rigid spigot bearing insert locatable in the spout, the closure further comprising a flexible membrane having one or more dispensing apertures, the membrane seals against a central spigot of the insert so that the spigot blocks the one or more dispensing apertures, and in use positive product pressure pushes against the membrane to release the seal so that product can flow through the one or more dispensing apertures, in which the flexible membrane fits into the spout and the insert clips into the spout to retain the flexible membrane, and in which in a rested position the flexible membrane sits upon and deforms to the contours of the insert and central spigot feature seated underneath the flexible membrane, in which the insert comprises an outer ring from which extend three spokes that carry the central spigot, wherein the flexible membrane is formed to include two or more legs extending from a bottom of the flexible membrane, each of the two or more legs extending between the three spokes of the insert, wherein each of the two or more legs includes a lower end with a foot coupled thereto, and wherein each foot extends radially outward away from the respective leg relative to a central axis of the closure such that the outer ring of the insert is arranged radially between the two or more legs and the feet, and the two or more legs and the feet cooperate to secure the insert into position.

2. The closure of claim 1, in which the base, the insert and the membrane are all formed separately from each other and are assembled together.

3. The closure of claim 1, in which the flexible membrane has a central dispensing aperture.

4. The closure of claim 1, in which the membrane is constructed of a TPE type material.

5. The closure of claim 1, in which the insert is produced in HDPE or PP.

6. A pack comprising the closure of claim 1 and a squeezable container filled with product.

7. The pack of claim 6, in which upon the application of positive pressure to the pack, the internal product flows towards the membrane through holes within the insert to the membrane, in which whilst the positive pressure is maintained upon the pack, the product pushes against the flexible membrane to release an interference seal on the central spigot feature, in which once the interference seal is broken, the product can flow over the central spigot and through the central hole within the flexible membrane component, and in which once the pressure is released the product will cease to flow and the flexible membrane will return to its relaxed seated position and recreate the seal preventing any leakage of product.

8. The closure of claim 1 in combination with a container.

9. The closure of claim 1, in which each leg of the two or more legs of the flexible membrane extends only partway around a circumference of the flexible membrane.

10. The closure of claim 9, in which the two or more legs are circumferentially spaced apart from each other so as to form a gap between the two legs.

11. The closure of claim 1, in which the wall of the insert extends axially downwardly and the feet of the flexible membrane extend axially upwardly such that an axially inner end of the wall is located between the feet and corresponding two or more legs of the flexible membrane.

12. The closure of claim 11, in which the flexible membrane further includes an annular center wall that extends axially upwardly, and in which upper ends of the two or more legs of the flexible membrane are attached to and extend axially downwardly away from an axially upper annular edge of the annular center wall.

13. The closure of claim 1, in which each foot of the flexible membrane extends from a lower end of the foot coupled to the lower end of a corresponding leg of the two or more legs to an upper end of the foot opposite the lower end of the foot, and in which the foot has a generally constant transverse thickness from the lower to upper end as measured in the radial direction of the flexible membrane.

* * * * *